United States Patent [19]

Briley et al.

[11] 4,035,857

[45] July 19, 1977

[54] DIVERS BUOYANCY VEST

[75] Inventors: Ronald D. Briley, Wheeling; Vernon G. Pedersen, Chicago, both of Ill.

[73] Assignee: Dacor Corporation, Northfield, Ill.

[21] Appl. No.: 535,418

[22] Filed: Dec. 23, 1974

[51] Int. Cl.[2] ..... B63C 11/02

[52] U.S. Cl. ..... 9/342; 9/314

[58] Field of Search ..... 9/313, 314, 316, 329, 9/330, 331, 333, 340, 341, 342, 343, 344, 345, 346, 347, 348, 349

[56] References Cited

U.S. PATENT DOCUMENTS

| | | | |
|---|---|---|---|
| 874,026 | 12/1967 | Necker | 9/342 |
| 2,842,785 | 7/1958 | Sieverts | 9/342 X |
| 3,877,098 | 4/1975 | Braly | 9/313 |

*Primary Examiner*—Trygve M. Blix
*Assistant Examiner*—Gregory W. O'Connor
*Attorney, Agent, or Firm*—Edmond T. Patnaude

[57] ABSTRACT

An inflatable buoyancy vest employs an open weave elastic gusset between the front and rear panels of the vest to hold the vest in a compact condition when the vest is deflated.

4 Claims, 3 Drawing Figures

DIVERS BUOYANCY VEST

The present invention broadly relates to inflatable diving vests of the type worn by scuba divers for purposes of buoyancy control and safety.

BACKGROUND OF THE INVENTION

In order to facilitate swimming at any given depth, scuba divers commonly wear an inflatable vest connected by control valve means and a flexible hose to the scuba tank. Manipulation of the control valve means may thus be used to regulate the net buoyancy of the diver and his equipment at any given depth. For rapid assent in an emergency the vest may be quickly inflated to greatly increase the net buoyancy of the diver to raise him to the surface.

While such vests theoretically enable the diver to control his net buoyancy at any particular depth their use has been limited by the excessive bulkiness of deflated vests having the buoyancy capabilities for use in relatively deep dives. Such bulkiness interferes with the diver's movements both while he is submerged and on the surface and makes storage and transportation of the vest difficult. It would, therefore, be desirale to provide an inflatable diving vest which is considerably smaller and more compact when deflated than are the diving vests of the prior art whereby they would be used more extensively.

SUMMARY OF THE INVENTION

Briefly, there is provided in accordance with the teachings of the present invention an inflatable diving vest incorporating a gusset formed of an open weave elastic fabric which compresses the front and rear panels of the vest together into a compact condition until the vest is inflated. A flexible nonresilient gusset is provided internally of the elastic gusset to prevent over inflation of the bladder.

BRIEF DESCRIPTION OF THE DRAWING

Further objects and advantages and a better understanding of the present invention can be had by reference to the following detailed description, wherein.

DETAILED DESCRIPTION OF THE INVENTION

Figure 3:
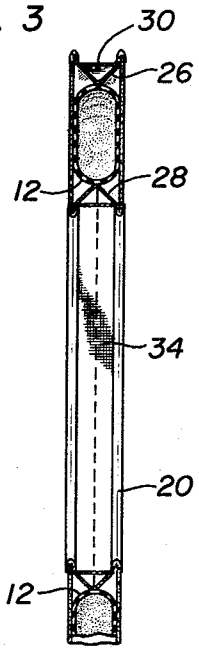
FIG. 3 is a sectional view of the vest of FIG. 1 taken along the line 3—3 thereof.

Referring now to the drawing, a buoyancy control and safety diving vest 10 includes as its principal elements an inflatable bladder 12 formed of rubber or the like, a flexible, nonresilient protective cover 14, and an air inlet-outlet connector 16 communicating with the bladder. A flexible hose 18 is adapted to supply air from a scuba tank (not shown) to the vest and to connect the bladder to the ambient to release air therefrom. Both the bladder 12 and the cover 14 are provided wth an opening 20 for receiving the neck of the diver. It will be understood by those skilled in the art that the vest 10 also includes a harness for securing the vest in place as well as one or more relief valves. If desired, an auxiliary inflating mechanism for supplying carbon dioxide gas from a $CO_2$ cartridge may be incorporated in the vest for safety purposes, and a separate bladder may be provided for inflation by $CO_2$ should the vest also be used as an emergency source of air for breathing.

The cover 14 comprises a pair of front and rear flexible, nonresilient panels 22 and 24 which are sewn together along the bottom as indicated at 25. These panels may be formed, for example, of urethane coated nylon fabric. A gusset 26 conveniently made of the same material as the panels 22 and 24 is sewn to the peripheral edge portions of the panels along the sides and top. A similar gusset 28 interconnects the panels around the neck opening 20. The panels 22 and 24 and the gussets 26 and 28 are impervious to water and gas, and therefore, a plurality of relief openings 30 are provided in the front panel 22 near the top and bottom of the vest to prevent fluid from being trapped between the cover and the bladder.

The widths of the gussets 26 and 28 determine the extent to which the bladder may expand and should, therefore, be as large as possible. Oversize front and rear panels have also been used to permit substantial expansion of the bladder. In either case, however, when the bladder is deflated the vest is bulky, hangs loosely on the diver and generally interferes with his normal movements. Consequently, the prior art vest designs have necessarily been a compromise between comfort and buoyancy, wherefor the buoyancy capabilities of the vests have been impaired.

Figure 2:
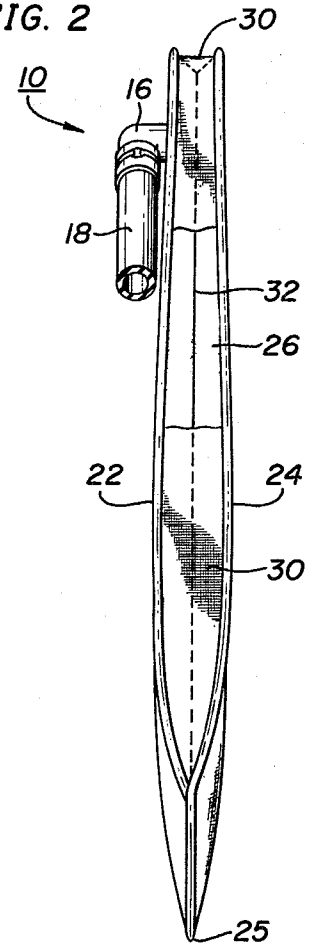
FIG. 2 is a side elevational view, partly broken away, of the vest shown in FIG. 1.
Figure 1:
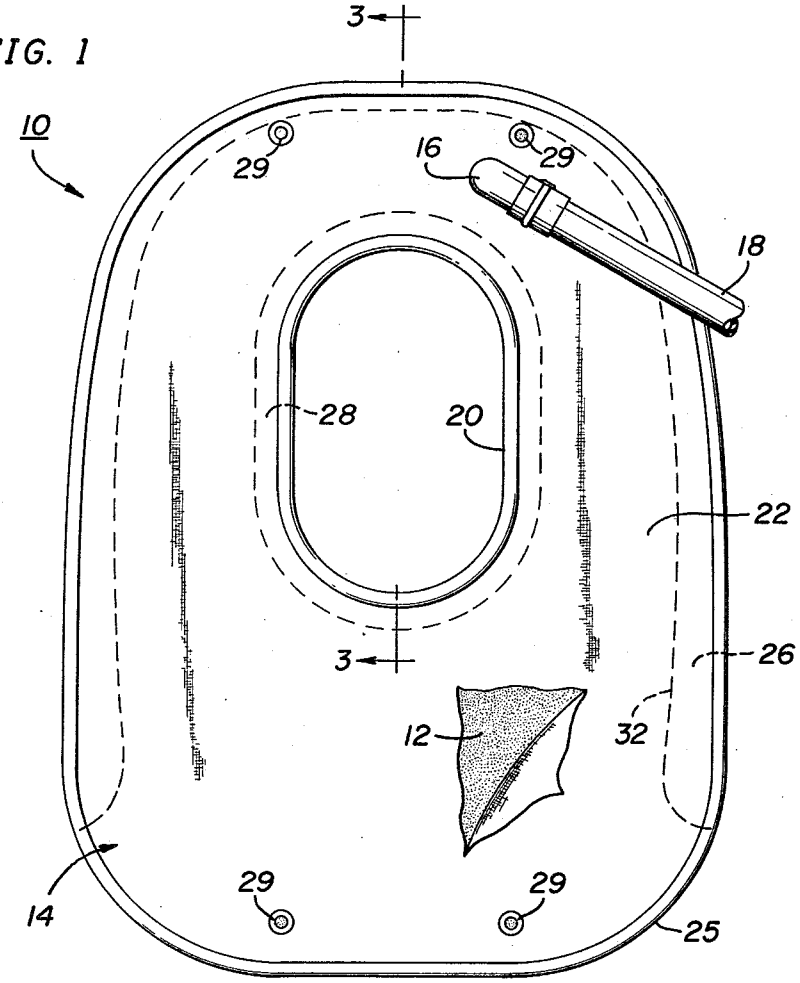
FIG. 1 is a front view of a buoyancy control diving vest embodying the present invention, only those portions of the vest which are relevant to the invention are shown.

In accordance with the present invention, an elastic gusset 30 is sewn to the peripheral portions of the cover panels 22 and 24 over the gusset 26 and the gusset 26 has a crease 32 so that when the bladder is deflated the gusset 26 folds inwardly under the force exerted by the elastic gusset 30. In FIG. 2 the vest is shown in a deflated condition. When the bladder is supplied with air or $CO_2$ gas the elastic gusset 30 stretches so that the bladder may expand to the full limit of the nonresilient gusset 26. The elastic gusset 30 is formed of an open weave fabric to permit water to flow into and out of the space between the gussets 26 and 30 as the bladder expands and contracts. As shown in FIG. 2 the gussets 26 and 30 are both tapered inwardly toward the top so that the vest is relatively thin in the area behind the divers neck. In an actual vest, the relaxed gusset 30 has a maximum width of two inches at the sides of the vest and three-quarters of an inch at the top. The gusset 26 has a maximum width of $3\frac{1}{2}$ inches at the sides tapering to two inches at the top.

Around the neck opening there is also provided an elastic gusset 34 overlying the gusset 28 and sewn to the edge portions of the front and rear panels surrounding the neck opening. If there is no need for the added buoyancy provided by the gusset 28, it and the gusset 34 can be eliminated and the covers sewn directly together around the neck opening.

The present invention thus enables a more compact diving vest which, when deflated, fits snugly against the body of the diver and yet provides substantial buoyancy when inflated.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A floatation device of the type including an inflatable bladder, comprising flexible cover means enclosing said bladder, said cover means including a resilient section of open weave resilient fabric material for exerting a compressive force on said bladder, and said cover means further including nonresilient means for limiting the expansion of said bladder to a predetermined extent, said cover means also including front and rear nonresilient flexible panel sections each having a peripheral edge portion and an edge portion surrounding a neck opening in said panel sections, said nonresilient means includes a flexible, nonresilient gusset connected between corresponding ones of said edge portions of said panel sections and said resilient section includes a reslient gusset connected between said corresponding ones of said edge portions externally of said non-resilient gusset.

2. A floatation device according to claim 1 wherein said resilient and nonresilient gussets are disposed at the peripheral edge portions of said panel sections.

3. A floatation device according to claim 1 wherein said nonresilient gusset is creased to provide an internal fold between said panel sections when said bladder is in a deflated condition.

4. A floatation device according to claim 1 wherein said resilient and nonresilient gussets are tapered so as to have a minimum width in the portion of said vest above said neck opening.

* * * * *